US007850317B2

(12) United States Patent
Blackburn et al.

(10) Patent No.: US 7,850,317 B2
(45) Date of Patent: Dec. 14, 2010

(54) GUARDRAIL BLOCK AND REFLECTOR SYSTEM

(75) Inventors: Robert Blackburn, Nokomis, FL (US); Robert Williams, Brandon, FL (US); Scott Woss, Fort Myers, FL (US)

(73) Assignee: BWW Enterprises, Inc., Tampa, FL (US)

( * ) Notice: Subject to any disclaimer, the term of this patent is extended or adjusted under 35 U.S.C. 154(b) by 0 days.

(21) Appl. No.: 12/617,588

(22) Filed: Nov. 12, 2009

(65) Prior Publication Data

US 2010/0118401 A1 May 13, 2010

Related U.S. Application Data

(60) Provisional application No. 61/113,790, filed on Nov. 12, 2008.

(51) Int. Cl.
*G02B 5/12* (2006.01)
*F16L 3/00* (2006.01)

(52) U.S. Cl. ..... 359/552; 256/13.1; 52/33; 248/66

(58) Field of Classification Search ..... 359/551, 359/552; 256/13.1, 19; 52/33, 720.1, 720.3; 248/66
See application file for complete search history.

(56) References Cited

U.S. PATENT DOCUMENTS 5,190,394 A * 3/1993 Mallon et al. ..... 404/6
6,007,269 A 12/1999 Marinelli
6,168,346 B1 1/2001 Ernsberger
6,530,560 B2 3/2003 King
6,733,205 B2 5/2004 Brown et al.
6,758,627 B2 7/2004 King
7,234,687 B2 6/2007 King

FOREIGN PATENT DOCUMENTS

JP 07-026526 A 1/1995
KR 20-0378906 Y1 3/2005
KR 10-0683047 B1 2/2007

* cited by examiner

*Primary Examiner*—Stephone B Allen
*Assistant Examiner*—Jennifer L. Doak
(74) *Attorney, Agent, or Firm*—Christopher Paradies; Fowler White Boggs P.A.

(57) ABSTRACT

A guardrail block includes an attachable support for signage, such as a reflector. The reflector may be mountable on the support, and the support may be integrated with a base or may be separate and attached to the base. For example, a support may be snap fit into the base and the base can be slip fitted into recessed channels formed in elongated extensions extending from a top surface of the guardrail block. The guardrail block may be made of a synthetic foam material, the support and base may be die injection molded, and the reflector may be reflective tape adhered to a surface of the support, for example.

14 Claims, 13 Drawing Sheets

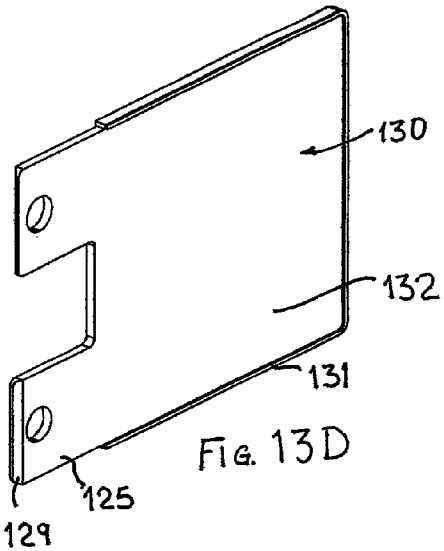
FIG. 13D
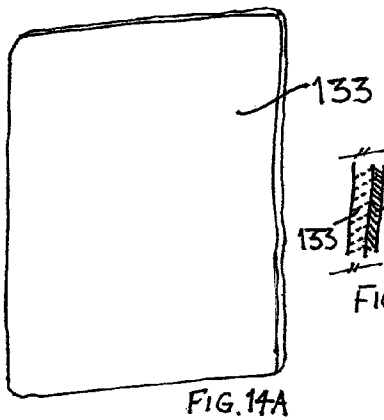
FIG. 14A
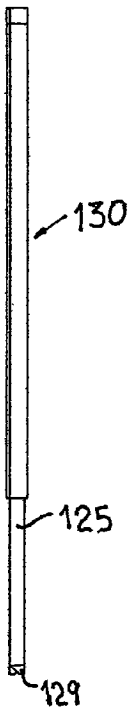
FIG. 14B
FIG. 13C
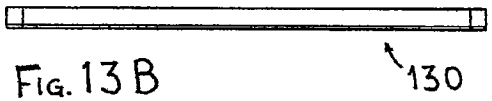
FIG. 13B
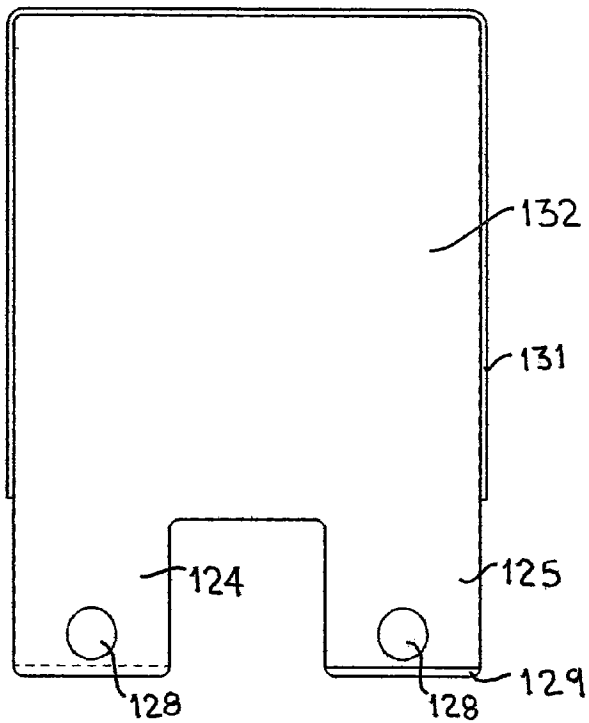
FIG. 13A

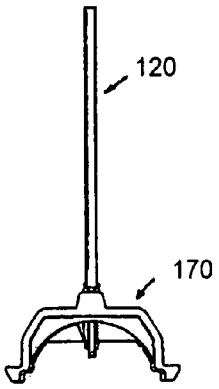
FIG. 19A
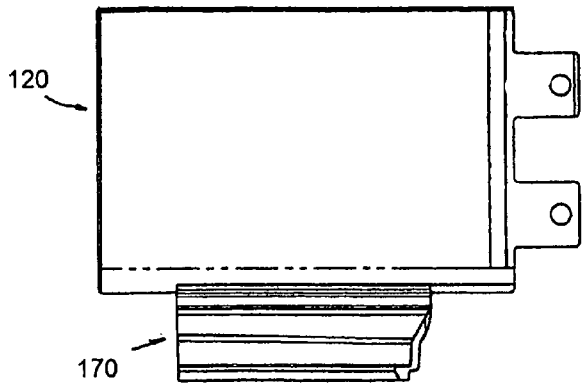
FIG. 19B
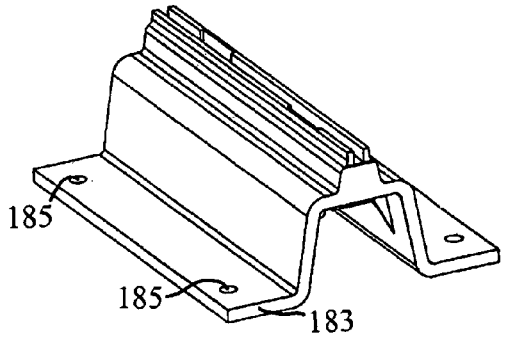
FIG. 18C
FIG. 18A
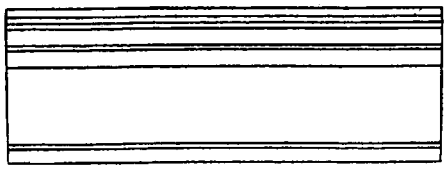
FIG. 18B
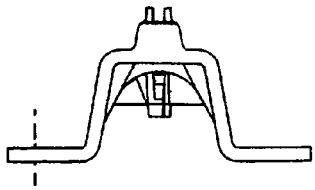

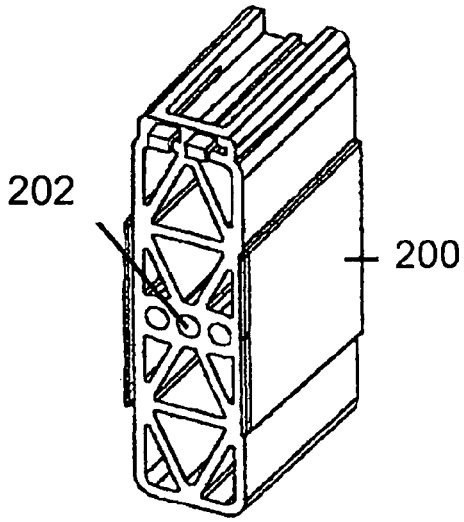
FIG. 22
FIG. 23
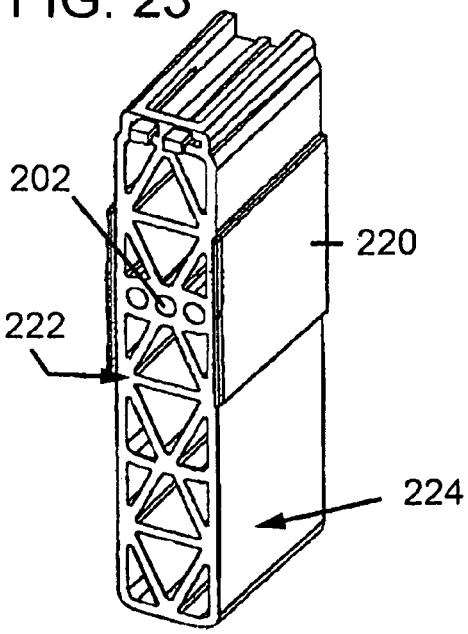

GUARDRAIL BLOCK AND REFLECTOR SYSTEM

RELATED APPLICATION

This application claims the benefit of U.S. Provisional Application 60/113,790 filed Nov. 12, 2008, which is incorporated herein in its entirety.

FIELD OF THE INVENTION

The field relates to guardrails used to redirect vehicles back onto a roadway, especially to guardrail blocks that act as a deflection buffer between posts set in concrete and guardrails supported by the posts.

BACKGROUND

U.S. Pat Nos. 6,007,269; 6,168,346; 6,530,560; 6,758,627; 7,234,687 disclose guardrail supports, attachments and positioning blocks used for positioning of a guardrail on posts during installation and thereafter. No accommodation is made for adding of a reflector or signage to the guardrail support.

SUMMARY

A guardrail block and reflector system includes a reflector and/or signage support having a plurality of feet extending from an upright holding member, the plurality of feet shaped to matingly engage with a channel formed in a top surface of the guardrail block.

A guardrail block may be made of an elastically deformable material and may be formed to include channels in a top side of the guardrail block such that feet extending from an upright holding member may be retained in the channels formed on the top side of the guardrail block. By supporting a reflector, the upright holding member acts as a support and improves visibility of highway guardrails at night and in bad weather conditions.

BRIEF DESCRIPTION OF THE DRAWINGS

The following drawings illustrate, and the detailed description describes, examples of a guardrail block and reflector system. These examples should not be considered as limiting to the claims.

FIGS. 13A-D illustrate views of an alternative insertable support.

FIGS. 14A-B illustrate schematic views of a reflector mounted using an adhesive.

FIGS. 18A-C disclose another example of a receiving element.

FIGS. 19A-B illustrate a support snap fit into a receiving element.

FIG. 22 illustrates another guardrail block.

FIG. 23 illustrates yet another guardrail block.

DETAILED DESCRIPTION

Figure 2:
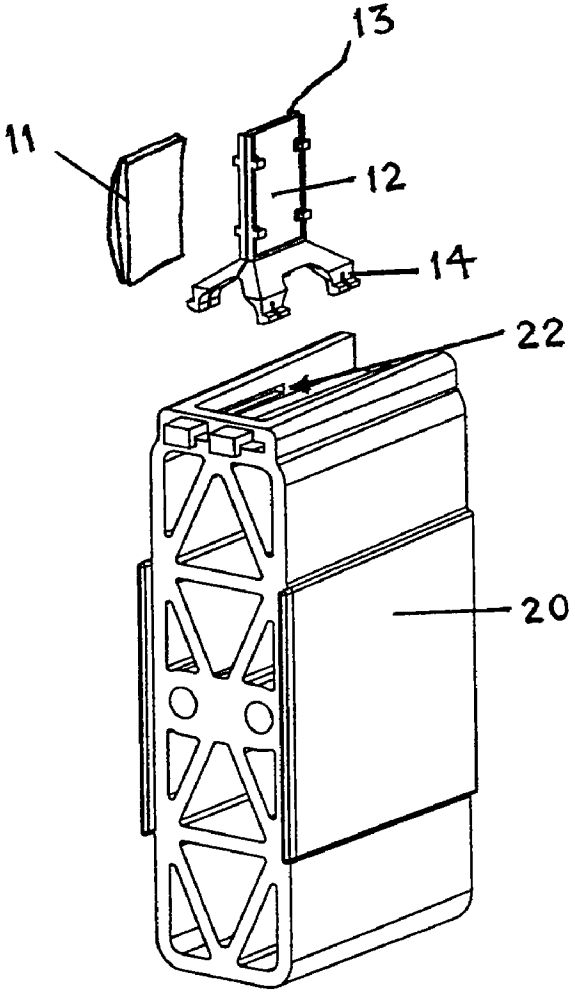
FIG. 2 illustrates an exploded view of the example in FIG. 1.
Figure 1:
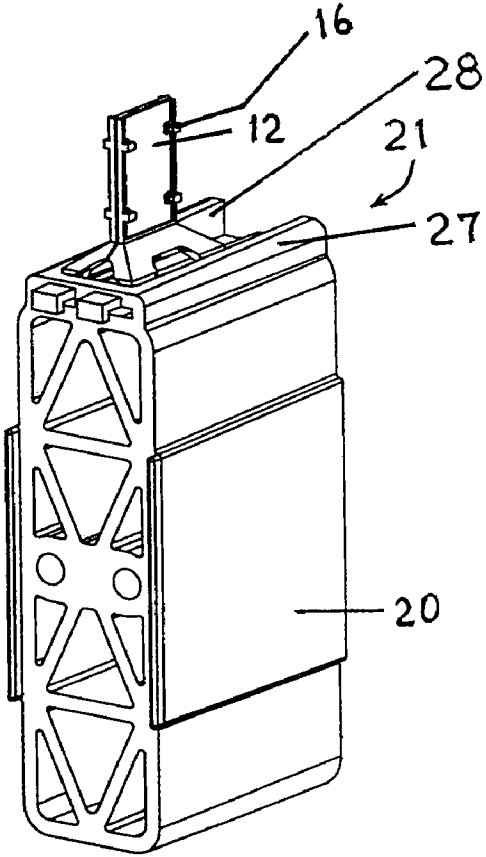
FIG. 1 illustrates a perspective view of an example of a reflector/signage support mounted on a top surface of a guardrail block.
Figure 5:
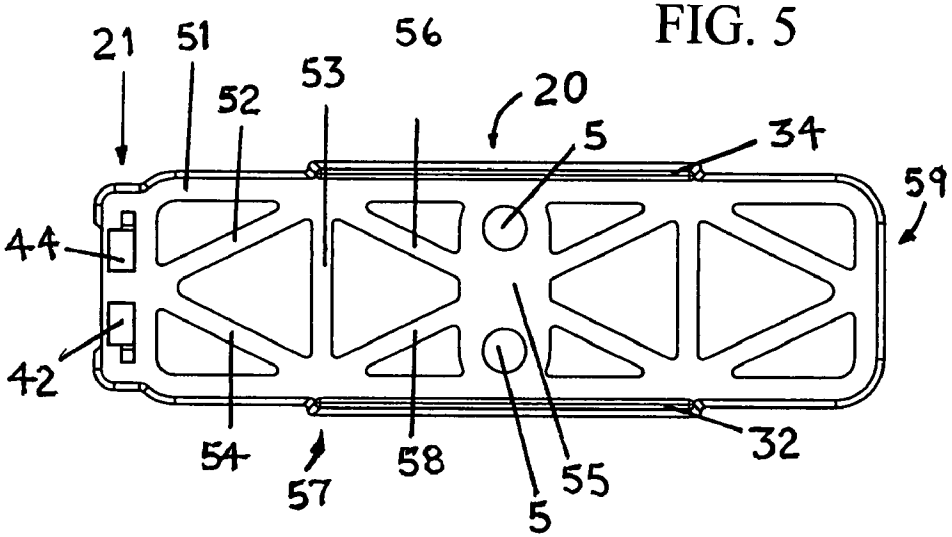
FIG. 5 illustrates a back plan view of the back of the guardrail block of FIG. 1.

In the example of FIG. 1, a guardrail block 20 is illustrated with a reflector and/or signage support 12 mounted in recessed channels (not shown) that are formed in a top portion 21 of the guardrail block 20. The reflector support 12 has four retaining members 16 formed in two pairs on opposite edges of the support 12. The four retaining members 16 are capable of retaining a reflector 11 or signage, as illustrated in the exploded view of FIG. 2, for example. FIG. 2 shows a portion of one of a pair of recessed channels 22 formed in opposite sides 27, 28 of a top portion 21 of the guardrail block 20. In this example, four feet 14 extend from an upper portion 13 of the support 12. The four feet 14 include two pairs of feet extending outwardly in opposite directions, for example, and the two pairs of feet 14 engage the pair of channels 22 in each of the opposite sides 27 of the top portion 21 of the guardrail block 20.

Figure 6:
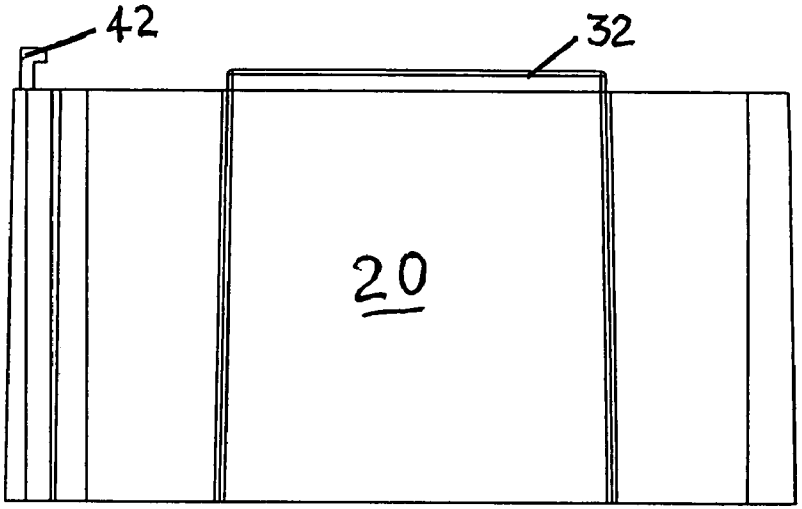
FIG. 6 illustrates a side plan view of the side of the guardrail block of FIG. 1.
Figure 4:
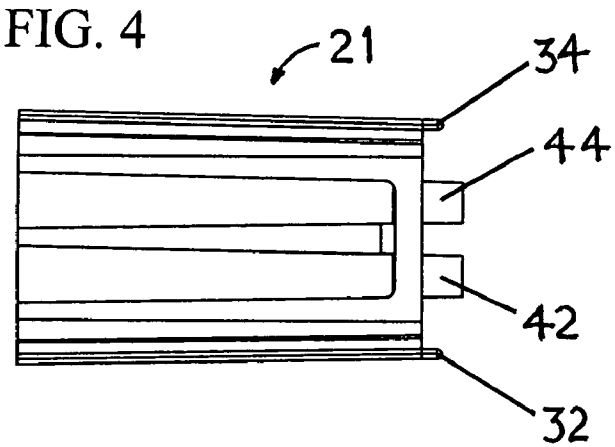
FIG. 4 illustrates a top plan view of the top portion of the guardrail block of FIG. 1.
Figure 3:
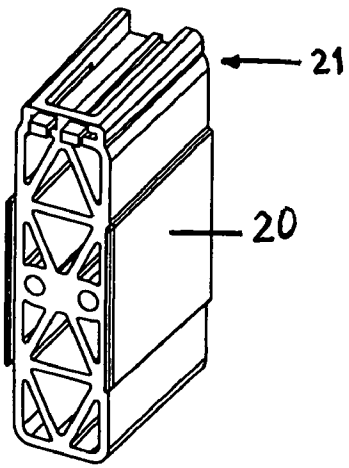
FIG. 3 illustrates a perspective view of only the guardrail block of FIG. 1.
Figure 9:
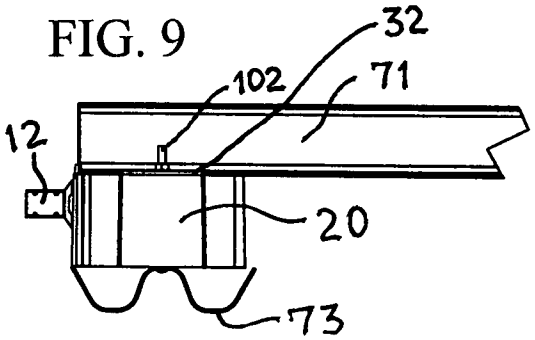
FIG. 9 illustrates a side view of an upper portion of the example of FIG. 7.
Figure 10:
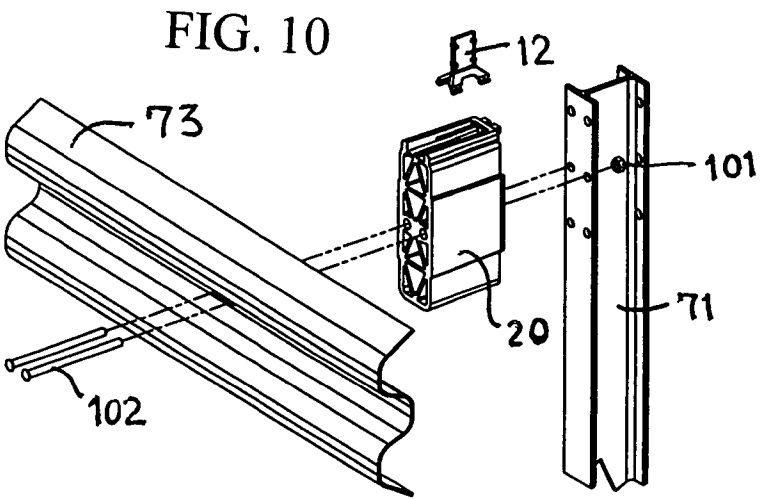
FIG. 10 illustrates an exploded, perspective view of the example of FIG. 7.
Figure 8:
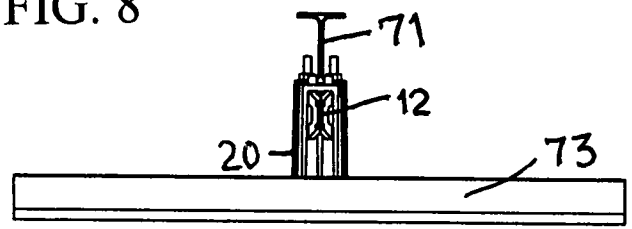
FIG. 8 illustrates a top plan view of the example of FIG. 7.
Figure 7:
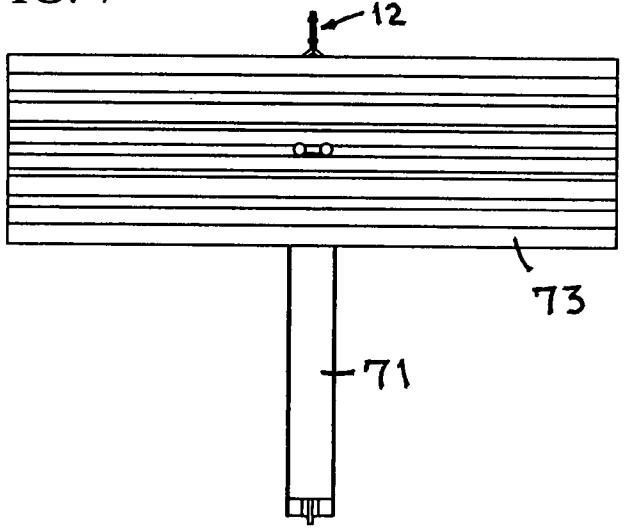
FIG. 7 illustrates a front plan view of an example of a guardrail block and reflector system as mounted on a post with a guardrail.

FIG. 3 illustrates an example of a guardrail block 20 having a top portion 21, which is illustrated in more detail in the top plan view of FIG. 4. Two tab 42, 44 are integrally formed, adhesively bonded, or affixed in the top portion 21 of the block 20. The tabs 42, 44 extend outwardly from the back of the block 20, as illustrated in FIGS. 3-6, for example. Two post alignment members 32, 34 are integrally formed in opposite sides of the block 20 and extend outwardly from the back of the block 20, such that a post 71 fits between the post alignment members 32, 34, as illustrated in FIGS. 7-10, which illustrate a guardrail 73 mounted with a block 20 and support 12 on a post 71 using a pair of bolts 102 and nuts 101 as fasteners. The bolts 102 pass through holes 5 integrally formed or bored through the block 20. Preferably, the block 20 is not solid. For example, a reinforcing truss may be formed by integrally formed members 52, 54, 56, 58 forming a diamond within an upper half 57 of a shell 51. An additional truss 53 may be disposed between to opposite corners of the diamond, as illustrated in FIG. 6. A middle portion 55 of the block 20 may provide two holes 5 for guiding two bolts 102 through matching holes in a post 71, for example. A lower half 59 of the block 20 may have a truss structure that minors the diamond truss structure of the upper half 57, symmetrically, for example.

Figure 11A:
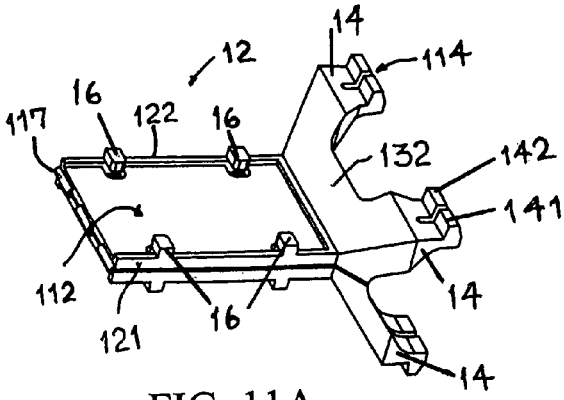
FIGS. 11A-11F illustrate detailed views of an example of a support.
Figure 11D:
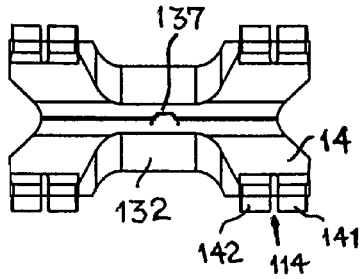
Figure 11B:
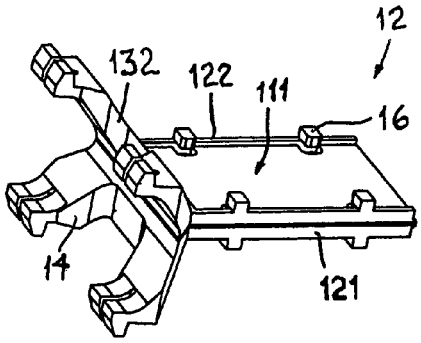
Figure 11E:
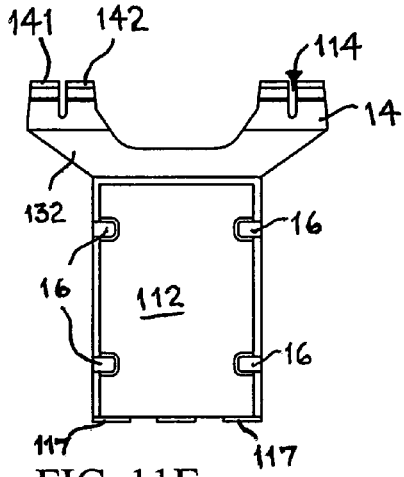
Figure 11C:
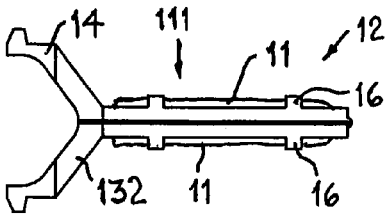
Figure 11F:
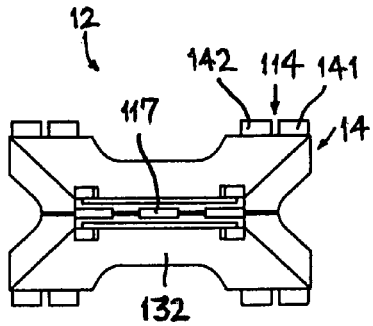
Figure 12C:
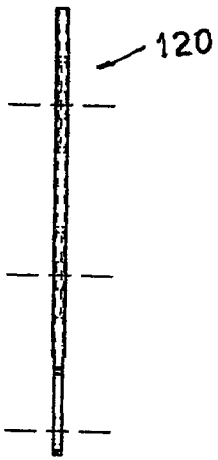
FIG. 12C illustrates a side plan view of the insertable support of FIG. 12A.
Figure 12D:
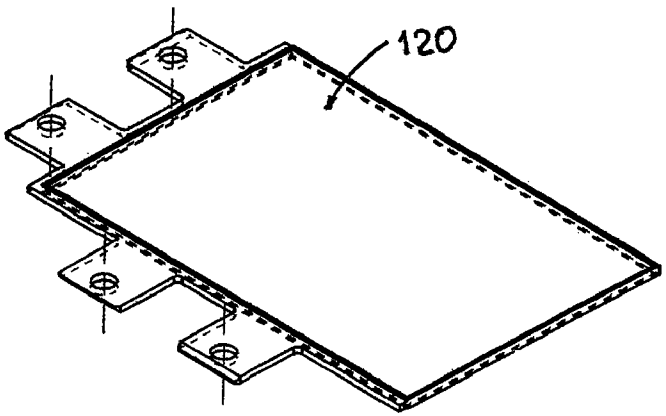
FIG. 12D illustrates a perspective view of the insertable support of FIG. 12A.
Figure 12A:
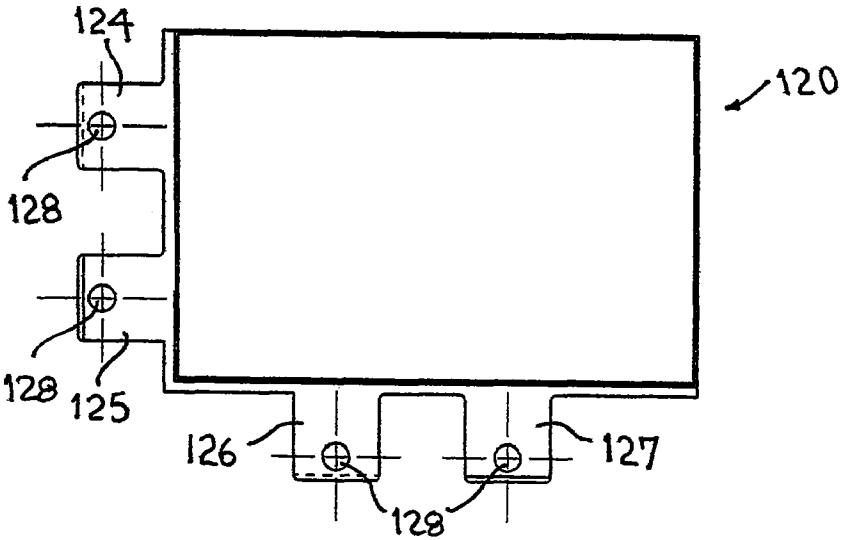
FIG. 12A illustrates a plan view of an insertable support.
Figure 12B:
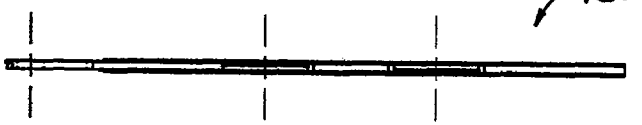
FIG. 12B illustrates a bottom plan view of the insertable support of FIG. 12A.
Figure 15D:
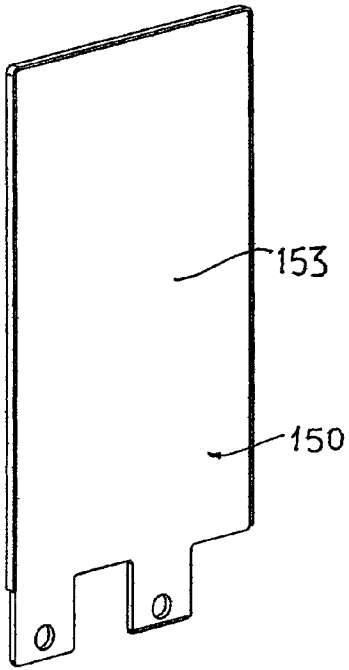
FIGS. 15A-D illustrate views of another alternative insertable support.
Figure 15B:
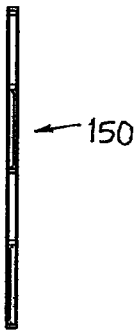
Figure 15C:
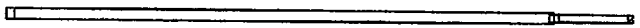
Figure 15A:
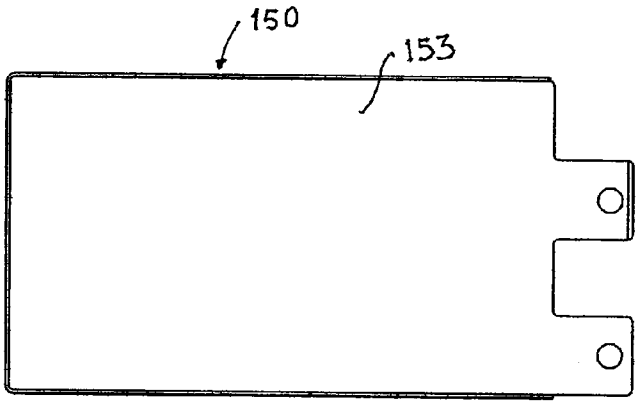
Figure 16D:
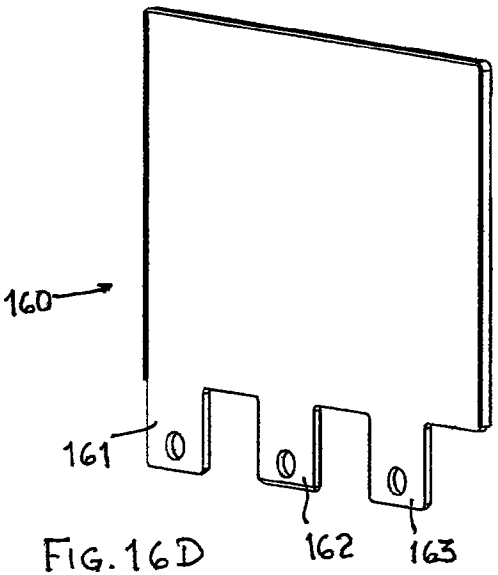
FIGS. 16A-D illustrate views of yet another alternative insertable support.
Figure 16C:
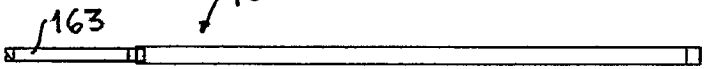
Figure 16A:
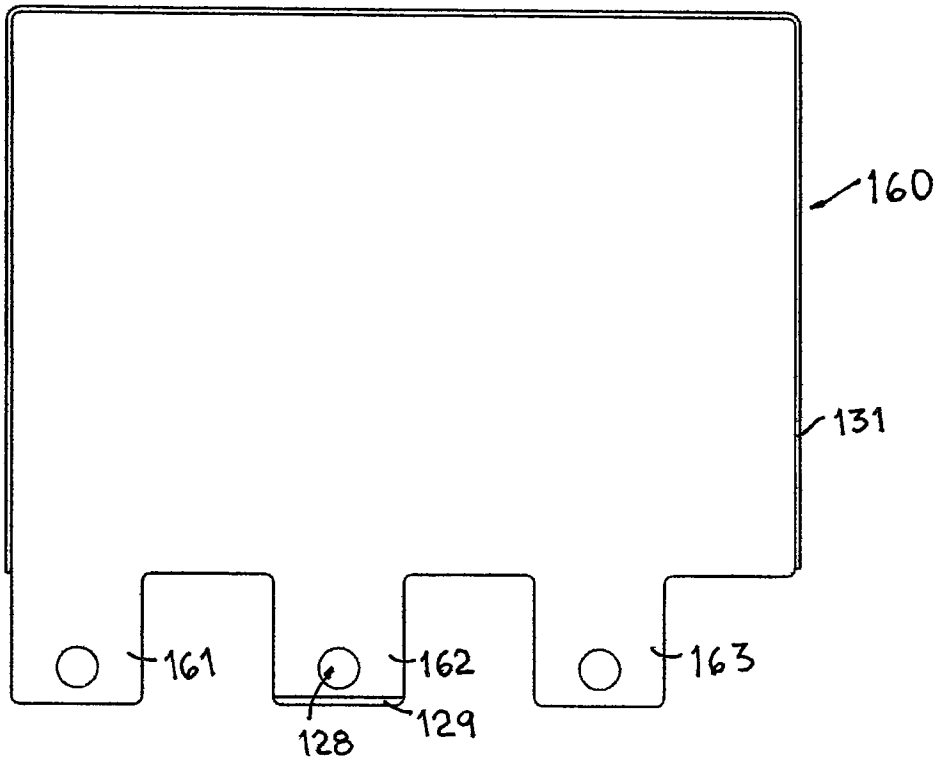
Figure 16B:
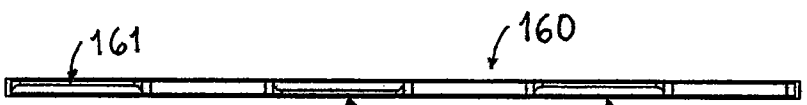

FIG. 11A illustrates a detailed, perspective view of an example of a reflector and/or signage support 12. The reflector support 12 has a plurality of retaining members 16, which may be formed in two pairs on opposite edges 121, 122 of the support 12. In the example of FIGS. 11A-11B, the support 12 has two opposite faces 111, 112 each having four retaining members 16, four of the retaining members 16 extending from each of the opposite faces 111, 112, such that the plurality of retaining members 16 are capable of retaining a reflector 11 or other signage on each of the faces 111, 112 of the support 12, as illustrated in FIG. 11C, for example. A pair of feet 14 are integrally formed with each of the faces 111, 112 and extend outwardly from a bottom portion 132 of each of the faces 111, 112. The two opposite faces 111, 112 of the support 12 may be formed in single die injection or forming process and may be folded along a top bend line or hinged portion 117 or may be adhesively bonded or snap fit 137 together, for example (FIG. 11D) or a combination of these. The feet 14 may each comprise a slit 114 separating two opposite toes 141, 142 of each foot 14 as illustrated in FIGS. 11E and 11F, for example. The slit 114 unexpectedly improves the durability of the feet 14 by preventing a complete failure when too much force is applied while inserting the feet 14 in opposite channels 22 of the top portion 21 of the block 20.

Other combinations and modifications to the features will be apparent to a person of ordinary skill in the art based on the examples in the drawings and the written description. All of these combinations and modifications are within the scope of the claims, which are not to be limited to only the examples provided.

In another example of a support, FIGS. 12A-D illustrate various views of an insertable support 120 that has four tabs 124, 125, 126, 127 each having an attachment locking portion 128, such as a hole, slot, slit, recessed region or the like capable of receiving a snap fit projecting member of a receiving element (or alternatively a projection capable of being snap fit into a recess or the like in the receiving element). Alternatively, FIGS. 13A-D illustrate an insertable support with only two tabs 124, 125 separated by a gap and having an attachment portion 128 and a beveled insertion edge 129. The example of FIGS. 13A-D better illustrate a raised edge 131 that forms a recessed surface portion 132 that is capable of receiving a adhesively-backed reflective tape 133, such as provided by the 3M Corporation, or other signage, having an adhesive 134 layer on one surface to adhere the reflective tape 130 to the support 130, such as illustrated in FIG. 14A and the partial cross sectional detail of FIG. 14B, for example. The edge 131 may be dimensioned such that it is capable of protecting the adhesively bonded tape 130 from the elements, improving long term bonding of the tape 133 to the surface 132. The insertable support 150 of FIGS. 15A-D illustrate the same features of the support 130 of FIGS. 13A-D with a more elongated support surface 152, providing an elongated length of up to 10 inches (25.4 centimeters) for the reflective tape 133, for example, without changing the receiving element. In yet another alternative, FIGS. 16A-D illustrate an example of an insertable support 160 with a plurality of tabs 161, 162, 163 each separated from the other by a gap and projecting outwardly from one side of of the support 160. For example, three tabs 161, 162, 163 are inserted in the receiving element instead of two. The various examples of the insertable supports may be made by die injection, extrusion or stamping from a sheet of material, for example. Examples including a raised edge 131 are preferably made in a die injection process. Examples of materials include polymers, such as thermoplastic and thermoset polymers. In one example, a fiber reinforced thermoplastic polymer, such as a nylon or glass fiber impregnated thermoplastic polymer, is used providing improved rigidity and long term weathering and resistance to wear and tear.

Figure 17E:
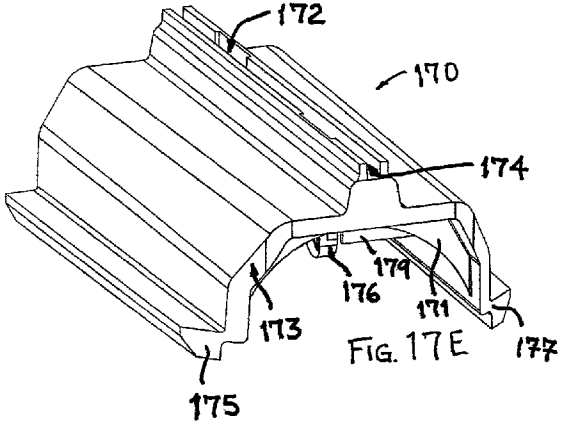
FIG. 17E illustrates a perspective view of the receiving element of FIG. 17A.
Figure 17A:
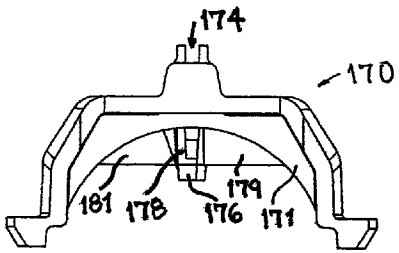
FIG. 17A illustrates an end plan view of a receiving element.
Figure 17D:
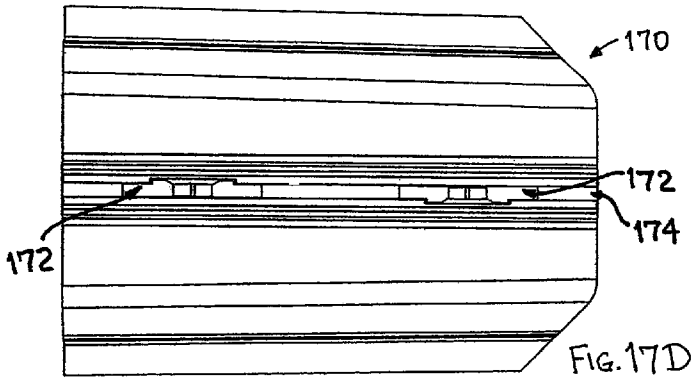
FIG. 17D illustrates a top plan view of the receiving element of FIG. 17A.
Figure 17C:
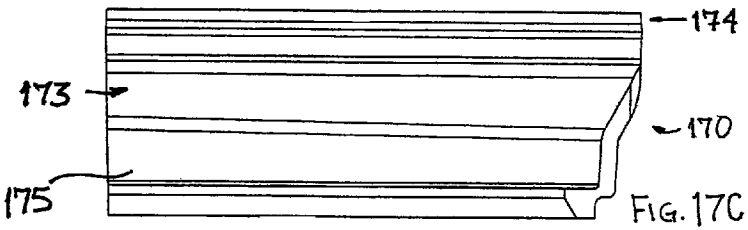
FIG. 17C illustrates a side plan view of the receiving element of FIG. 17A.
Figure 17B:
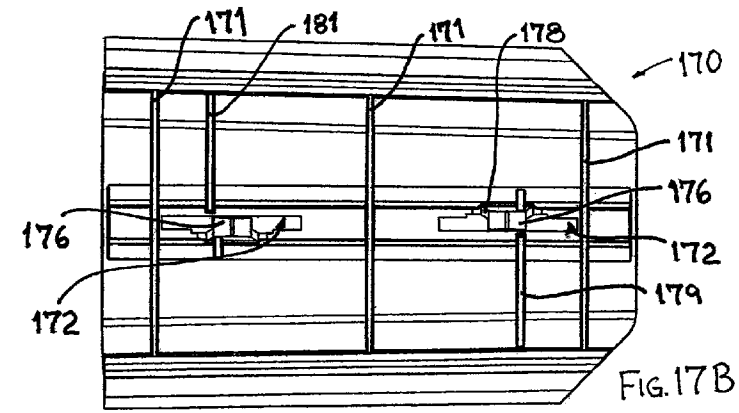
FIG. 17B illustrates a bottom plan view of the receiving element of FIG. 17A.

The example of FIGS. 17A-E illustrate various views of a receiving element 170 capable of receiving two tabs of an insertable support. In one example, the receiving element is formed by a thermoplastic die injection process providing a one-piece, integrated receiving element 170, such as the receiving element with the features illustrated in FIGS. 17A-E, for example. Tab slots 172 are provided along a channel 174 formed in the receiving element 170 for receiving the tabs of an insertable support. When the tabs are inserted into the slots 172, the attachment portion 128 engages a snap fit projecting member 176 projecting from the surface of an extending member 178. As illustrated in FIGS. 17A, B and E, arcuately shaped support members 171 may be integrally molded into the underside of the receiving element 170 to stiffen the base 173 of the receiving element 170. In this example, no separate feet are provided. Instead, the legs 175, 177 extend to form integrally formed, snap fitting feet capable of engaging the recessed channels 22 of a guardrail block 20.

Figure 20A:
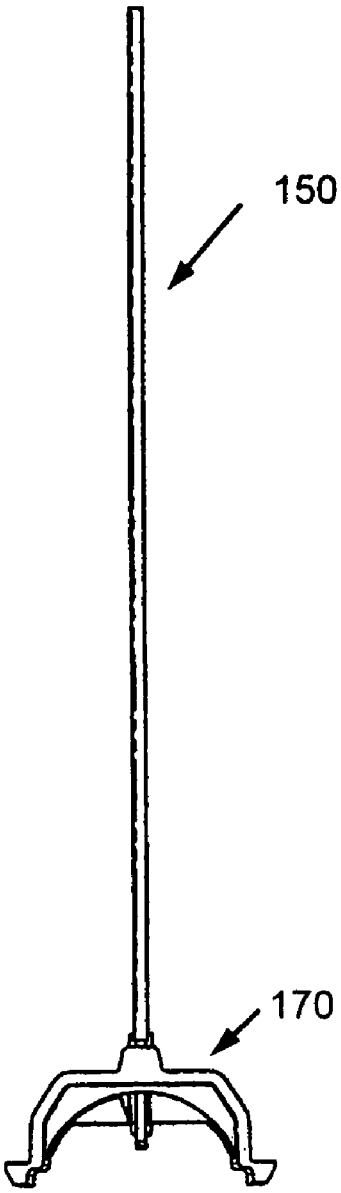
FIGS. 20A-B illustrate another support snap fit into a receiving element.
Figure 20B:
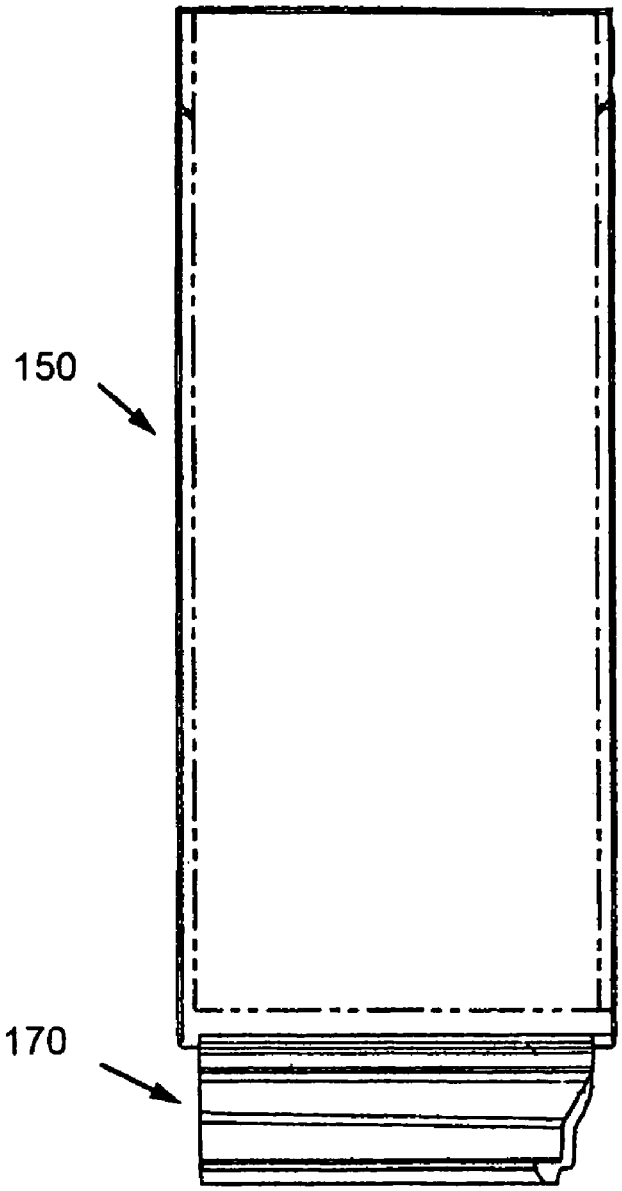
Figure 21D:
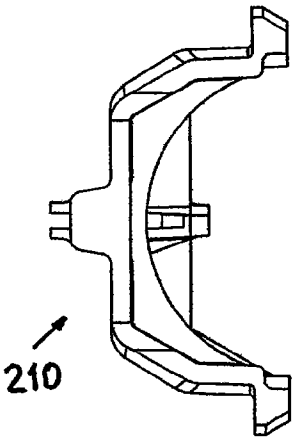
FIGS. 21A-D illustrate views of yet another receiving element.
Figure 21C:
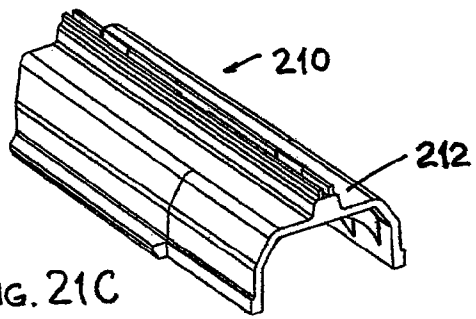
Figure 21B:
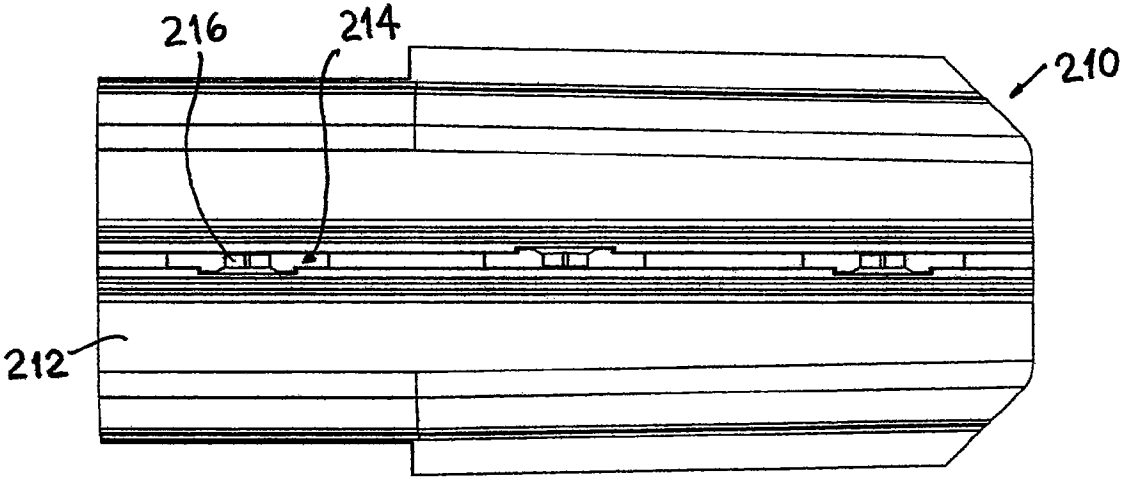
Figure 21A:
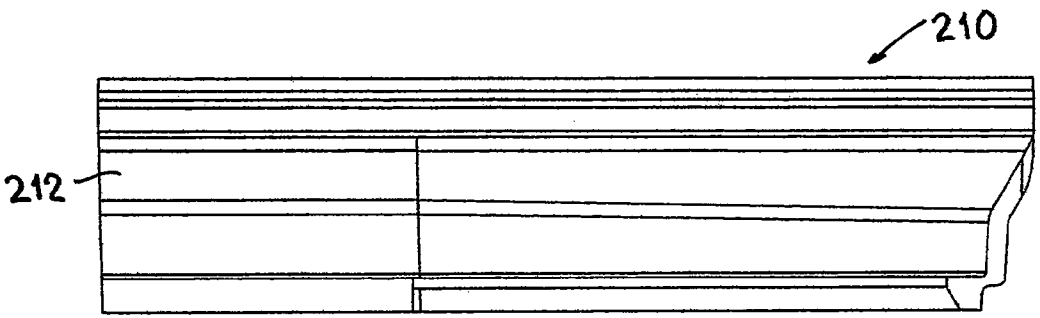

FIGS. 19A-B illustrates a support 120 snap fit into a receiving element 170. FIGS. 20A-B illustrates another support 150 snap fit into the same receiving element 170.

The example of FIGS. 18A-C illustrate an alternative example of a receiving element 180 having integrally formed feet 183 with preformed holes 185 for use in fastening the receiving element 180 on a guardrail block.

FIGS. 21A-D illustrate various views of an extended receiving element 210 similar to the receiving element 170 in FIGS. 17A-E, except with an extended receiving portion 212 having a third tab slot 214 and a third projecting member 216 for snap fitting into the attachment portion 128 of a third tab 163 of a support 160, such as the one illustrated in FIGS. 16A-16D.

In one example, such as illustrated in FIG. 22, a guardrail block 200 has a third through hole 202 extending through the block for an alternative attachment arrangement using a single bolt to hold the block and guardrail on a post. In another example, such as illustrated in FIG. 23, a guardrail block 220 may be elongated to fit onto a wider guardrail than the guardrail 73 illustrated in FIGS. 7-10. For example, an additional one-half of the length of the block may be integrally formed by repeating the extruded profile of the lower one-half 222 of the block in an block extension 224 extending below the end of the previously disclosed block 200.

What is claimed is:

1. A guardrail comprising:

a post;

a guardrail;

a guardrail block having a retention portion formed at a top surface of the guardrail block, the retention portion having two opposite recessed channels; and a support extending above the top surface of the guardrail block, the support being coupled to a base having oppositely facing feet, each of the oppositely facing feet engaging a respective one of the two opposite recessed channels.

2. The guardrail of claim 1, wherein the support, the base and the oppositely facing feet are an integrally formed unit.

3. The guardrail of claim 2, wherein the support has a first face, a second face and a hinge integrally joining the first face to the second face, such that, when the first face and the second face are folded back-to-back by bending the first face and the second face about the hinge, the feet are oppositely facing one from the other.

4. The guardrail of claim 1, wherein the support and the base are separate parts, and the support includes a plurality of tabs, each of the plurality of tabs being retained in a respective slot formed in the base.

5. The guardrail of claim 4, wherein the base includes at least one projecting member arranged with relation to the slot such that the projecting member engages an attachment portion of one of the plurality of tabs, snap fitting the one of the plurality of tabs into the slot of the base.

6. The guardrail of claim 5, wherein the attachment portion is a hole, and the projecting member projects from a flexible extending member such that the projecting member engages the hole in at least one of the tabs, when the tabs are fit into the slots of the base.

7. The guardrail of claim 6, wherein a brace extends from an underside of the base such that, when the plurality of tabs are inserted into the respective slots of the base, the brace extends adjacently to a surface of the tab, preventing the tab from flexing beyond the surface of the brace adjacent to the surface of the tab.

8. The guardrail of claim 7, wherein the tabs, the brace and the projecting member fixedly locks the support into the base, when the plurality of tabs are inserted into the slots of the base.

9. The guardrail of claim 8, wherein each of the oppositely facing feet includes a slit partially dividing each of the oppositely facing feet into two portions.

10. A supported reflector for mounting on a top surface of a guardrail block, comprising:

an integrally formed base comprised of two legs attachable to the top surface of the guardrail block, a plurality of slots extending through an upper surface of the base within a channel defined by elevated portions extending from the upper surface of the base and extending along a length of the upper surface of the base in a longitudinal direction of the base, and a plurality of projecting members, each projecting from a plurality of extending members;

a support comprised of a supporting portion and a plurality of tabs extending outwardly from the supporting portion and having an attachment portion formed in each of the tabs; and a reflective tape mounted on the supporting portion of the support, such that, when the tabs are inserted in respective ones of the slots, each of the plurality of projecting members engages the attachment portion of one of the plurality of tabs, fixedly retaining each of the plurality of tabs within respective ones of the plurality of slots, such that the reflector extends above the top surface of the guardrail block.

11. The supported reflector of claim 10, wherein the reflective tape includes an adhesive bonding the reflective tape to a surface of the supporting portion of the support.

12. The supported reflector of claim 11, wherein the supporting portion includes a recessed portion, and the reflective tape is mounted on the recessed portion.

13. The supported reflector of claim 12, wherein the recessed portion is defined by elevated edges extending from the surface of the supporting portion on at least two edges of the supporting portion.

14. The supported reflector of claim 13, wherein the at least two edges include a top edge and an edge facing in the direction of traffic, when the supported reflector is mounted on a guardrail block.

* * * * *